US009333668B1

(12) United States Patent
Goddard

(10) Patent No.: US 9,333,668 B1
(45) Date of Patent: May 10, 2016

(54) SYSTEM AND METHOD FOR CONVERTING BEVERAGE CONTAINERS WITH REMOVABLE LIDS INTO SPILL-RESISTANT SIPPY CUPS

(71) Applicant: John W. Goddard, Columbus, IN (US)

(72) Inventor: John W. Goddard, Columbus, IN (US)

( * ) Notice: Subject to any disclaimer, the term of this patent is extended or adjusted under 35 U.S.C. 154(b) by 0 days.

(21) Appl. No.: 14/795,810

(22) Filed: Jul. 9, 2015

(51) Int. Cl.
*B26F 1/36* (2006.01)
*A47G 19/22* (2006.01)
*A47G 21/18* (2006.01)

(52) U.S. Cl.
CPC ..... *B26F 1/36* (2013.01); *A47G 19/2272* (2013.01); *A47G 21/18* (2013.01); *B26F 2001/365* (2013.01)

(58) Field of Classification Search
CPC . B26F 1/36; B26F 2001/365; A47G 19/2272; A47G 21/18; A47G 19/2266; Y10T 29/49826
USPC ..... 29/428; 220/705, 709, 712; 215/229, 215/388
See application file for complete search history.

(56) References Cited

U.S. PATENT DOCUMENTS 4,291,464 A * 9/1981 Garrett ..... B26F 1/36 30/360
4,566,605 A * 1/1986 Rogers ..... B65D 47/103 220/712
5,425,471 A * 6/1995 Wendt ..... B26D 7/1827 215/388
6,598,757 B2 * 7/2003 Stillinger ..... B65D 5/746 215/387
8,286,827 B2 * 10/2012 Yacktman ..... B65D 25/48 220/780
8,464,888 B2 * 6/2013 Hayashi ..... B65D 47/36 215/229
2006/0086744 A1 * 4/2006 Li ..... A47G 19/2272 220/709
2006/0201955 A1 * 9/2006 Stribling ..... A45F 3/16 220/705
2007/0181522 A1 * 8/2007 Davidson ..... B65D 47/0814 215/228

* cited by examiner

*Primary Examiner* — David Bryant
*Assistant Examiner* — Lawrence Averick
(74) *Attorney, Agent, or Firm* — Roberts IP Law; John Roberts

(57) ABSTRACT

Provided in various example embodiments is a system and method for converting beverage containers with removable lids into spill-resistant sippy cups, optionally comprising a punch mechanism comprising a die handle connected with a die and pivotably connected with a punch handle connected with a punch that is positioned opposite the die, the punch and die operable to punch holes through upper surfaces of beverage container lids having longitudinally extending sides, such that the holes have a first cross-sectional size, shape, and area. Also provided are drinking straws each having a second cross-sectional size, shape, and area, the second cross-sectional area being less than the first cross-sectional area by a differential area sufficient in size and shape to allow the passage there through of air but not more than a few drops of a liquid beverage.

9 Claims, 12 Drawing Sheets

SYSTEM AND METHOD FOR CONVERTING BEVERAGE CONTAINERS WITH REMOVABLE LIDS INTO SPILL-RESISTANT SIPPY CUPS

CROSS-REFERENCE TO RELATED APPLICATIONS

None.

FEDERALLY SPONSORED RESEARCH OR DEVELOPMENT

None.

TECHNICAL FIELD

The subject matter disclosed herein relates generally to beverage containers, and more specifically to systems and methods for converting standard beverage containers having variously-sized removable lids into spill-resistant sippy cups.

BACKGROUND

Parents often provide their young children with "sippy cups" or other training cups to let children drink without spilling. Such cups typically include a lid with a drip-resistant spout that helps young children transition from baby bottles to regular cups. However, a drink must first be poured from its original container into the sippy cup, and the sippy cup lid attached, before the child can use it. The original container for the drink must be stored in a safe area until all its contents are used, sometimes after multiple fill-ups of the sippy cup. After use the sippy cup is typically cleaned and reused while the original container is typically discarded. This procedure is labor-intensive and often results in numerous sippy cups being scattered about, while the original drink containers are not utilized for drinking. It has been recognized that it would be beneficial to convert a regular drink container into a spill-resistant sippy cup. U.S. Pat. No. 8,286,827 B2, issued Oct. 16, 2012 to Yacktman, describes a sippy cup lid specially adapted to snap over the rim of a typical beverage can. But this only partially addresses the issue, because parents will still be faced with a deluge of sippy cup lids, which must be washed and reused. Moreover, drinks for children are increasingly packaged in containers other than standard beverage cans, while Yacktman's sippy cup lid will only fit standard beverage cans. For example, many drinks geared toward children, such as milk and juice containers at fast food restaurants, are now provided in plastic bottles with non-standardized screw-on lids of various shapes and sizes. Thus, a one-size-fits-all lid is not a feasible solution.

A disposable drink container popular with children is the flexible drink bag that is pierced by a plastic straw, an example of which is shown in U.S. Pat. No. 7,175,581 B2, issued Feb. 13, 2007 to Murray. While such drink bags eliminate the expense and labor associated with providing and maintaining separate sippy cups and lids, drink bags are not particularly spill-resistant, and are actually prone to squirting out their contents through the straw when the bag is compressed by dropping or squeezing.

What is needed is an inexpensive system and method of use that easily converts standard drink containers having any of a variety of possible sized and shaped lids into spill-resistant drinking containers for small children, without having to provide and maintain separate containers or lids.

SUMMARY

The present invention elegantly addresses the above challenges and provides numerous additional benefits as will be apparent to persons of skill in the art. Provided in various example embodiments are lid piercing devices and correspondingly-sized straws that together easily convert standard drink containers having any of a variety of possible sized and shaped lids into spill-resistant drinking containers for small children. No separate containers or lids are required, and the straw and original container can be disposed of and preferably recycled when the drink is finished.

For example and not by way of limitation, provided in various example embodiments is a method of converting beverage containers with removable and replaceable lids into spill-resistant sippy cups, comprising the steps of: removing a lid from a beverage container at least substantially filled with a beverage, the lid comprising a longitudinally extending sidewall and an upper portion having inner and outer surfaces; punching a hole through the upper portion of the lid by placing the upper portion of the lid on a die of a punch mechanism, clasping and pushing together a die handle and a punch handle of the punch mechanism, and causing the punch mechanism to drive a punch through the upper portion of the lid and into a die, thereby creating a hole-punched lid; causing the punch mechanism to remove the punch from the hole-punched lid; removing the hold-punched lid from the die of the punch mechanism; replacing the hole-punched lid on the beverage container containing the beverage; and partially inserting a drinking straw through the hole into the beverage in the beverage container, such that one or more air gaps are formed between the hole and an exterior surface of the drinking straw, the one or more air gaps being sufficiently large in size to facilitate sipping the beverage through the drinking straw, the one or more air gaps being sufficiently small in size to substantially prevent leakage of the beverage out of the container and the drinking straw if the beverage container is tipped over such that the beverage rests against the inner surface of the upper portion of the lid.

In various example embodiments the method may further comprise opening a scrap receptacle portion of the punch mechanism and removing therefrom a scrap slug that had been punched out of the lid. In various example embodiments the method may further comprise tipping over the beverage container such that the beverage rests against the inner surface of the upper portion of the lid; and leaking less than a substantial amount of the beverage out of the container and the drinking straw. In various example embodiments the longitudinally extending sidewall of the lid extends longitudinally for a first distance, and the die of the punch mechanism is elevated above the die handle by a second distance greater than the first distance, and the step of placing the upper portion of the lid on the die of the punch mechanism further comprises the steps of positioning the lid so that the longitudinally extending sidewall surrounds the die that is elevated above the die handle. In various example embodiments the longitudinally extending sidewall of the lid extends longitudinally for a first distance of at least 0.200 inches, and the die of the punch mechanism is elevated above the die handle by a second distance greater than the first distance, and the step of placing the upper portion of the lid on the die of the punch mechanism further comprises the steps of positioning the lid so that the longitudinally extending sidewall surrounds the die that is elevated above the die handle. In various example embodiments the step of punching a hole through the upper portion of the lid further comprises the step of punching a round hole of a first diameter through the upper portion of the lid, and the step of partially inserting a drinking straw through the hole further comprises the step of inserting a drinking straw through the hole where the drinking straw has a round cross-section and a second diameter smaller than the first diameter. In various example embodiments the drinking straw has a round cross-section and a second diameter smaller than the first diameter by 0.010 inches to 0.030 inches, or alternatively by 0.015 inches to 0.025 inches, for example. In various example embodiments the step of punching a hole through the upper portion of the lid further comprises the step of punching a hole through the upper portion of the lid such that the hole has one or more slots extending radially outward from an otherwise round perimeter of the hole, and such that the one or more slots form the one or more air gaps between the hole and the exterior surface of the drinking straw.

Also provided in various example embodiments is a system for converting beverage containers with removable and replaceable lids into spill-resistant sippy cups, comprising: a punch mechanism comprising a die handle connected with a die and pivotably connected with a punch handle connected with a punch that is positioned opposite the die, the punch and die operable to punch holes through upper surfaces of beverage container lids such that the holes have a first cross-sectional size, shape, and area; and a package of drinking straws, each drinking straw having a second cross-sectional size, shape, and area, the second cross-sectional area being less than the first cross-sectional area by a differential area sufficient in size and shape to allow the passage there through of air but not more than a few drops of a liquid beverage. In various example embodiments the system may further comprise the die of the punch mechanism elevated above the die handle by a distance greater than the longitudinal length of a longitudinally extending sidewall of a beverage container lid, wherein the longitudinal length of the longitudinally extending sidewall of the beverage container lid is alternatively at least 0.200 inches, 0.300 inches, 0.400 inches, or 0.500 inches, for example. In various example embodiments the system may further comprise the die of the punch mechanism being sized, shaped, and located so that an upper surface of the beverage container lid may be placed on the die while the longitudinally extending sidewall surrounds the die. In various example embodiments the system may further comprise the punch and die operable to punch round holes of a first diameter through upper surfaces of beverage container lids; and the drinking straws having a round cross-section with a second diameter less than the first diameter, for instance 0.010 inches to 0.030 inches less than the first diameter, or alternatively 0.015 inches to 0.025 inches less than the first diameter, for example. In various example embodiments the system may further comprise the punch and die operable to punch holes through the upper portions of beverage container lids where the holes have one or more slots extending radially outward from an otherwise round perimeter, such that the one or more slots form one or more air gaps between the holes and exterior surfaces of the drinking straws when inserted into the holes.

Further provided in various example embodiments is a system for converting beverage containers with removable and replaceable lids into spill-resistant sippy cups, comprising: means for punching holes through upper surfaces of beverage container lids such that the holes have a first cross-sectional size, shape, and area; and a package of drinking straws, each drinking straw having a second cross-sectional size, shape, and area, the second cross-sectional area being less than the first cross-sectional area by a differential area sufficient in size and shape to allow the passage there through of air but not more than a few drops of a liquid beverage. In various example embodiments the system may further comprise means for punching holes through upper surfaces of beverage container lids having longitudinally extending sidewalls that extend longitudinally at least 0.200 inches, 0.300 inches, 0.400 inches, or 0.500 inches, for example. In various example embodiments the system may further comprise means for punching holes through upper surfaces of beverage container lids such that the holes define one or more slots extending radially outward from an otherwise round perimeter.

Additional aspects, alternatives and variations as would be apparent to persons of skill in the art are also disclosed herein and are specifically contemplated as included as part of the invention. The invention is defined only by the claims as allowed by the patent office in this or related applications, and the following figures and descriptions of certain examples are not in any way to limit, define or otherwise establish the scope of legal protection.

BRIEF DESCRIPTION OF THE DRAWINGS

The accompanying figures illustrate certain aspects of example embodiments of the invention, wherein.

DETAILED DESCRIPTION OF EXAMPLE EMBODIMENTS

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the claims that will be appended in any subsequent regular utility patent application claiming priority to this provisional application.

In the following description, numerous specific details are set forth in order to provide a thorough understanding of the present invention. Particular example embodiments of the present invention may be implemented without some or all of these features or specific details. In other instances, components and process operations well known to persons of skill in the art have not been described in detail in order not to obscure unnecessarily the present invention.

Various techniques and mechanisms of the present invention will sometimes be described in singular form for clarity. However, it should be noted that some embodiments may include multiple iterations of a technique or multiple components, mechanisms, and the like, unless noted otherwise. Similarly, various steps of the methods shown and described herein are not necessarily performed in the order indicated, or performed at all in certain embodiments. Accordingly, some implementations of the methods discussed herein may include more or fewer steps than those shown or described.

Further, the techniques and mechanisms of the present invention will sometimes describe a connection, relationship or communication between two or more items or entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

Figure 9:
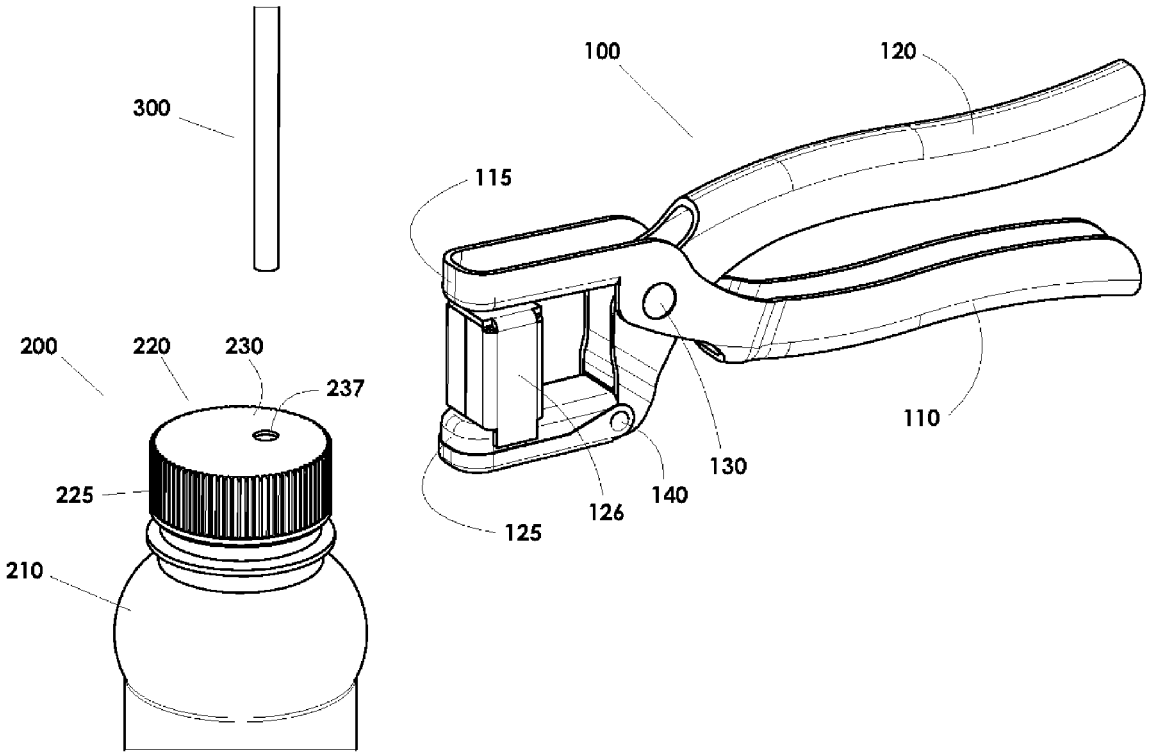
FIG. 9 is a front side perspective view of the beverage container, lid, and punch mechanism of FIG. 8, along with a lower portion of a straw sized and shaped to be sealably received within the hole punched in the lid, according to various example embodiments.
Figure 10:
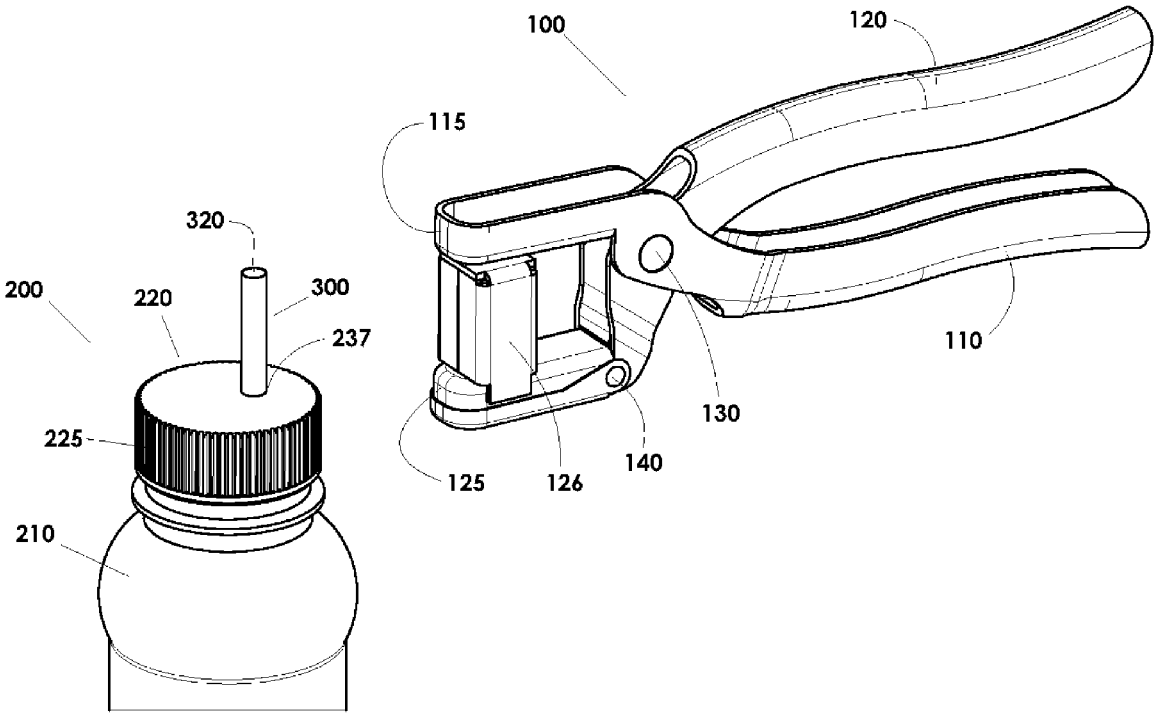
FIG. 10 is a front side perspective view of the beverage container, lid, punch mechanism, and straw of FIG. 9, with the lower portion of the straw inserted into the beverage container through the hole punched in the lid and an upper portion of the straw extending up from the lid for drinking the beverage, according to various example embodiments.

Turning to FIGS. 1 through 12D, shown is one example embodiment of a lid piercing device 100 and correspondingly-sized straws 300 (FIGS. 9-10) that together easily convert standard drink containers 200 having any of a variety of possible sized and shaped lids 220 into spill-resistant drinking containers for small children. No separate containers or lids are required, and the straw 300 and original container 200 can be disposed of and preferably recycled when the beverage is consumed or the drink is otherwise finished.

For example, provided in various example embodiments is a system 100, 300, for converting beverage containers 200 with removable and replaceable lids 220 into spill-resistant sippy cups, comprising a punch mechanism 100 comprising a die handle 120, 125 connected with a die 127 by a riser structure 126 and pivotably connected via a pivot joint 130 with a punch handle 110, 115 connected with a punch 117 that is positioned opposite the die 127. The punch 117 and die 127 are operable as shown in the Figures to punch holes 237 through upper surfaces 230 of beverage container lids 220 such that the holes 237 have a first cross-sectional size, shape, and area, for instance corresponding to cross-sectional areas 117A-117D shown in FIGS. 12A-12D. An example system 100, 300 may further comprise a package (not shown) of drinking straws 300, with each drinking straw 300 having a second cross-sectional size, shape, and area (for instance round, as shown in FIGS. 12A-12D), the second cross-sectional area being less than the first cross-sectional area by a differential area 400 sufficient in size and shape to allow the passage there through of air but not more than a few drops of a liquid beverage. Pivot joints mentioned herein, e.g., 130, 140, may comprise rivets, fasteners, joints with axles, or any suitably joints that join parts together while allowing them to pivot relative to one another.

Figure 3:
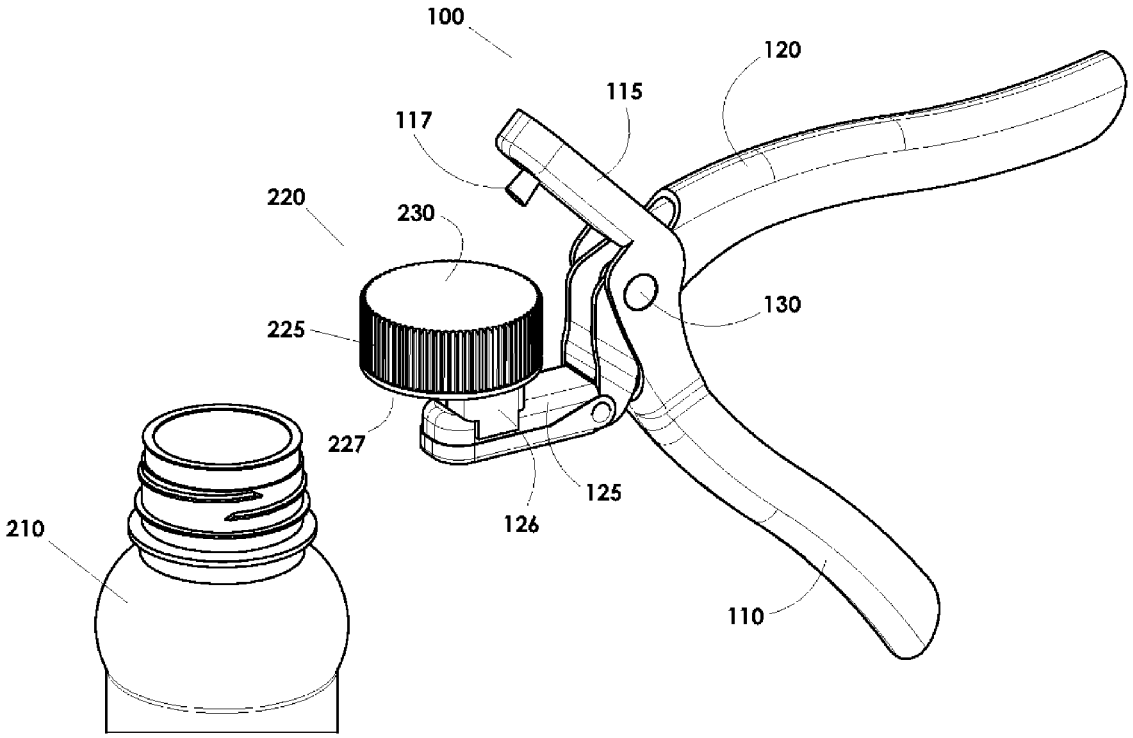
FIG. 3 is a front side perspective view of the beverage container, lid, and punch mechanism of FIG. 2, with the lid positioned on an elevated die of the punch mechanism and the punch mechanism in an open position, according to various example embodiments.
Figure 4:
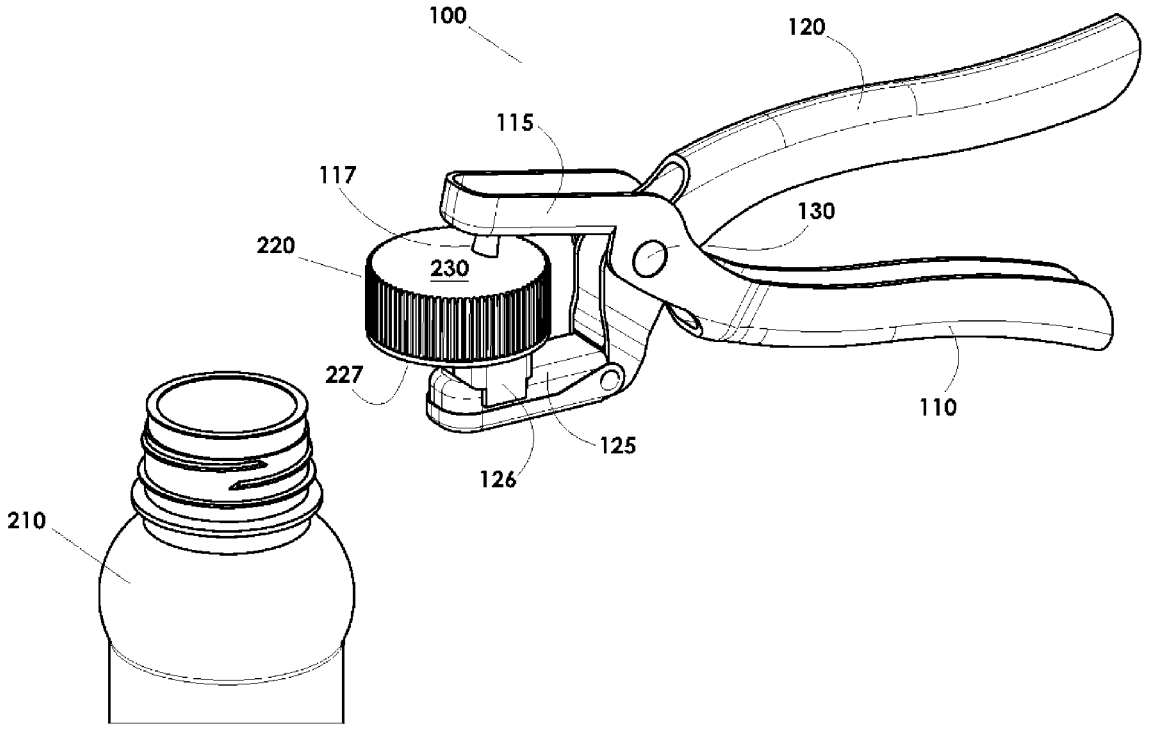
FIG. 4 is a front side perspective view of the beverage container, lid, and punch mechanism of FIG. 3, with the lid positioned on an elevated die of the punch mechanism and the punch mechanism closed against the lid, according to various example embodiments.

In various example embodiments the system 100, 300 may further comprise the die 127 of the punch mechanism 100 elevated above the die handle 125 by a distance h2 greater than the longitudinal length h1 of a longitudinally extending sidewall 225 of a beverage container lid 220. The longitudinal length h1 of the longitudinally extending sidewall 225 of the beverage container lid 220 may be any typical height, for example alternatively at least 0.200 inches, 0.300 inches, 0.400 inches, or 0.500 inches, for instance. In various example embodiments the system 100, 300 may further comprise the die 117 of the punch mechanism 100 being sized, shaped, and located above the die handle 125, for instance by a riser structure 126, so that an upper surface 230 of the beverage container lid 220 may be placed on the die 127 while the longitudinally extending sidewall 225 surrounds the die 127, for example as shown in FIG. 3.

Figure 12A:
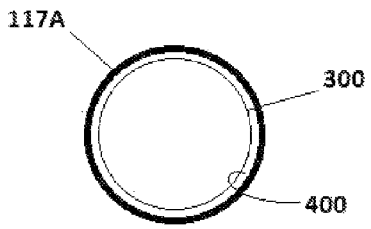
FIGS. 12A-D are bottom plan views of optional cross-sectional shapes for punches, showing the cross-section of drinking straws overlaid thereon, according to various example embodiments.
Figure 12B:
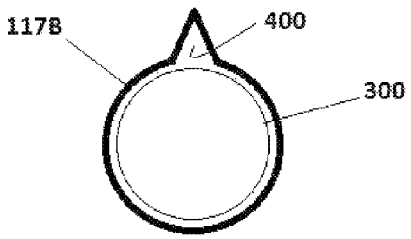
Figure 12C:
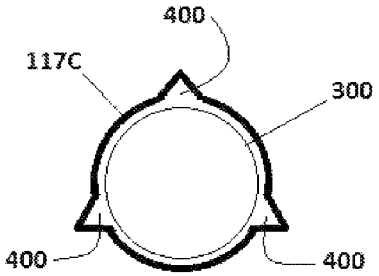
Figure 12D:
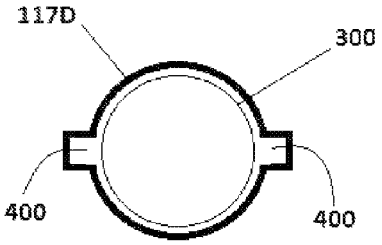

As depicted in FIG. 12A, in various example embodiments the system 100, 300 may further comprise the punch 117 and die 127 operable to punch round holes 237 of a first diameter 117A through upper surfaces 230 of beverage container lids 220, while the drinking straws 300 may have round cross-sections with a second diameter less than the first diameter, for instance 0.010 inches to 0.030 inches less than the first diameter, or alternatively 0.015 inches to 0.025 inches less than the first diameter, for example, creating an air gap 400 there between. In various example embodiments the system 100, 300 may further comprise the punch 117 and die 127 operable to punch holes 237 through the upper portions 230 of beverage container lids 220 where the holes 237 have one or more slots extending radially outward from an otherwise round perimeter, for example as shown in FIGS. 12B-12D, such that the one or more slots form one or more air gaps 400 between the holes 117B-117D and exterior surfaces of the drinking straws 300 when inserted into the holes 237. For example, an air gap 400 having a cross-sectional area at any point of about 0.020 inches by 0.020 inches has been found to work acceptably with typical beverages, but persons of skill in the art may determine other shapes and sizes of air gaps 400 that work appropriately well, all of which is intended to be within the scope of the invention.

Figure 1:
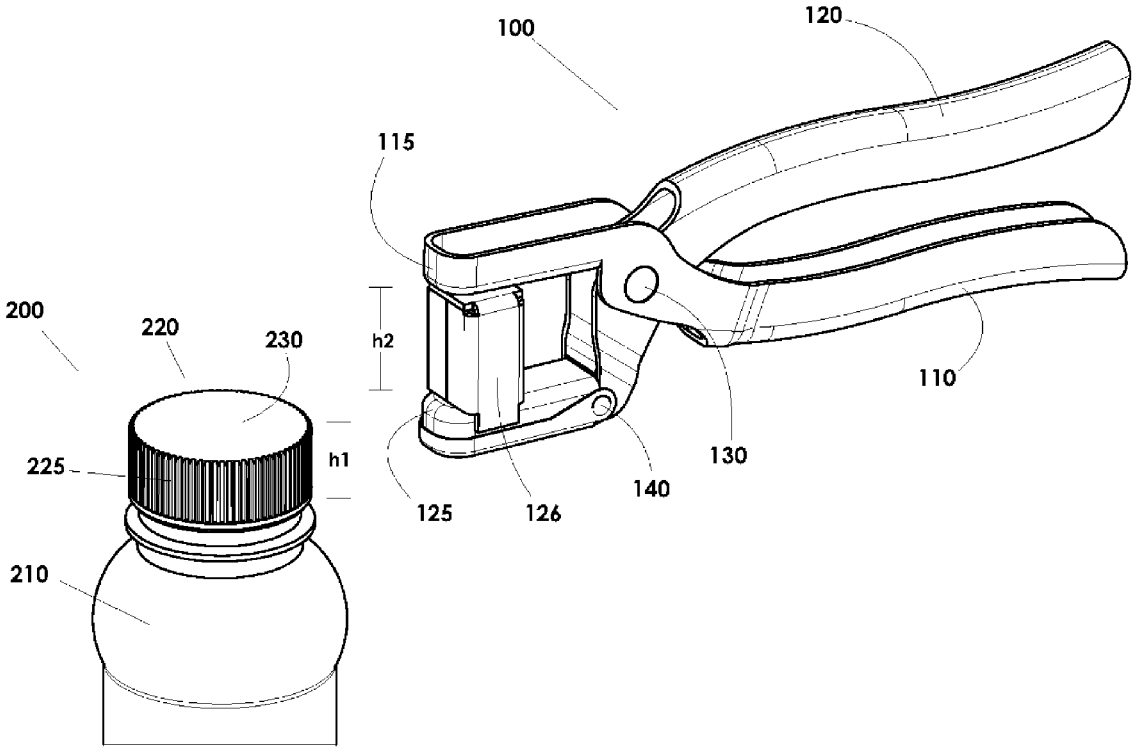
FIG. 1 is a front side perspective view of a beverage container with a removable lid, and a punch mechanism designed to convert beverage containers with removable lids into spill-resistant sippy cups, with the lid shown installed on the beverage container and the punch mechanism optionally in a fully closed position, according to various example embodiments.
Figure 2:
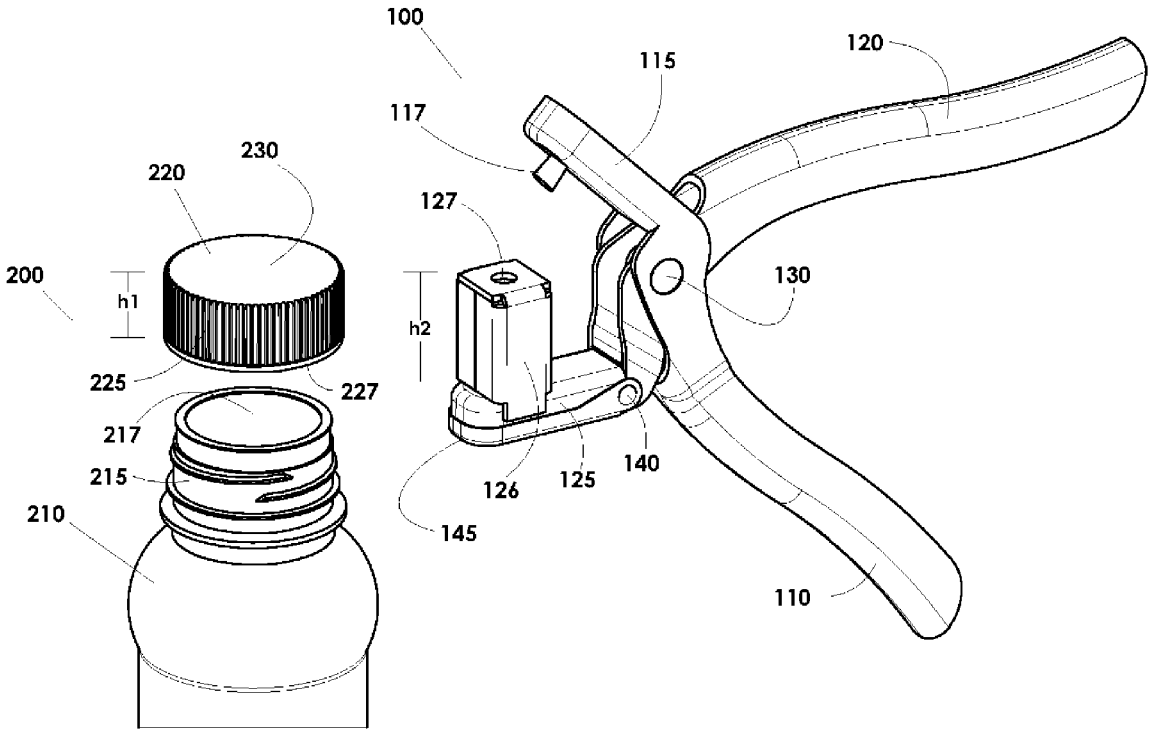
FIG. 2 is a front side perspective view of the beverage container, lid, and punch mechanism of FIG. 1, with the lid removed from the beverage container and the punch mechanism in an open position, according to various example embodiments.
Figure 5:
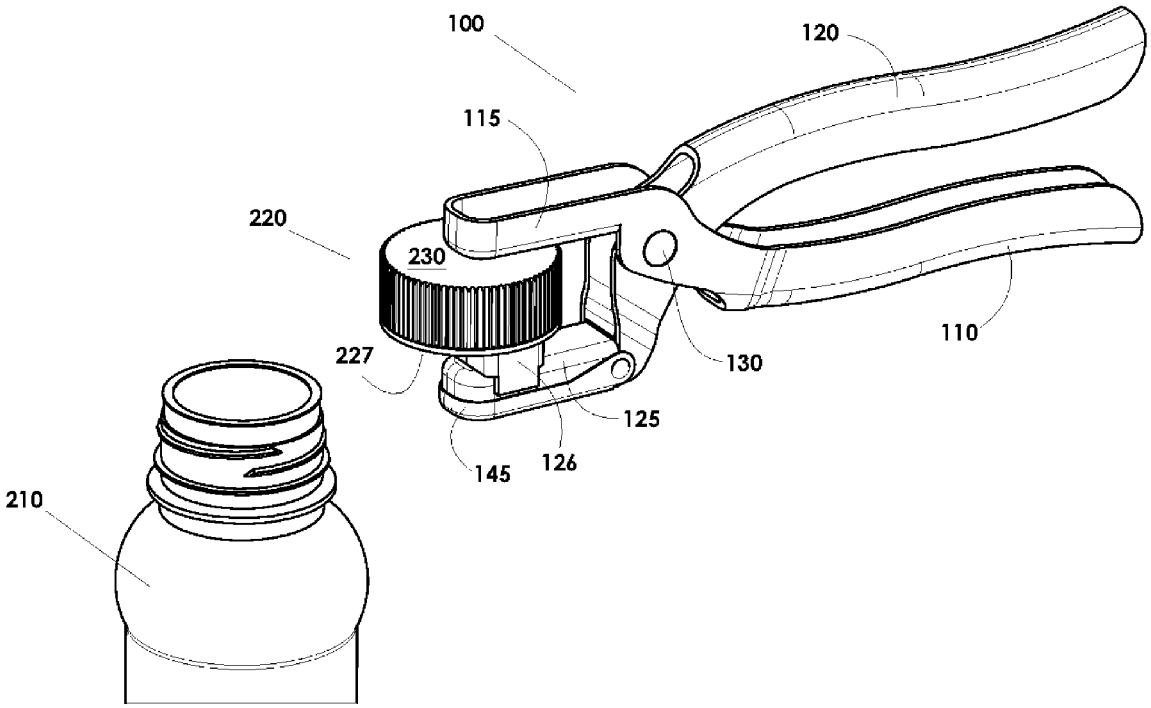
FIG. 5 is a front side perspective view of the beverage container, lid, and punch mechanism of FIG. 4, with the lid positioned on an elevated die of the punch mechanism and the punch mechanism in the fully closed position and punching a hole through the lid, according to various example embodiments.
Figure 6:
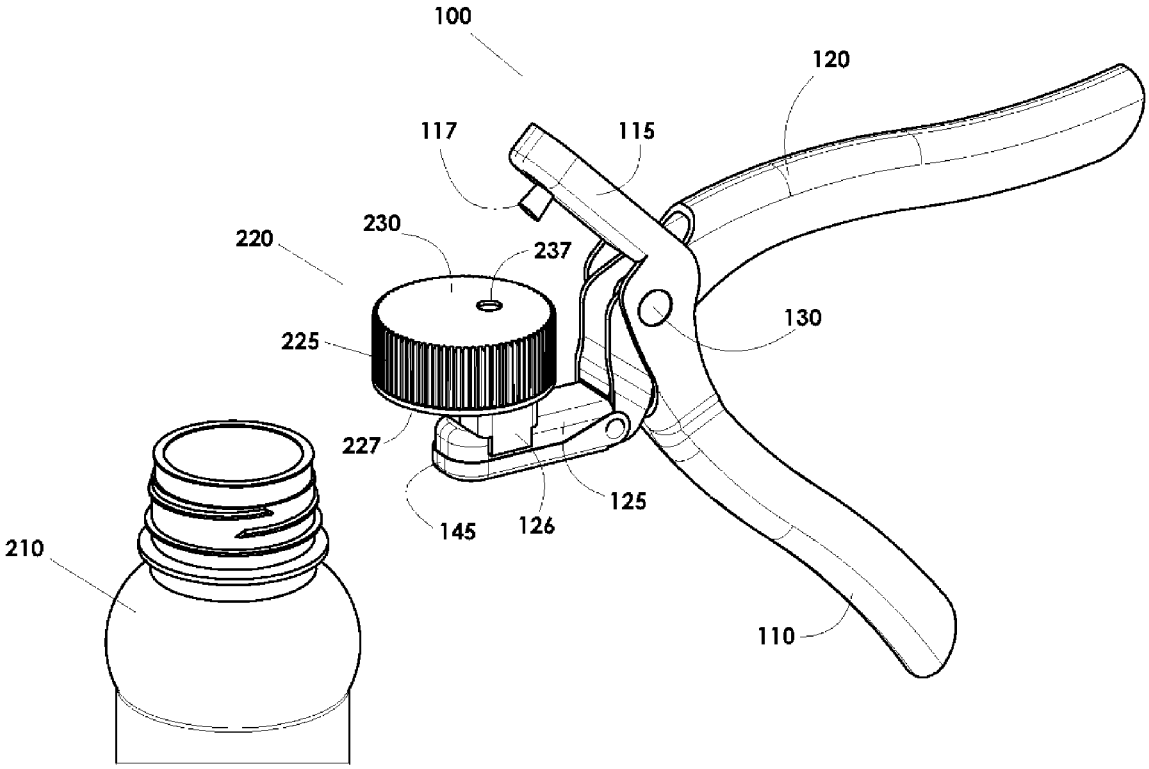
FIG. 6 is a front side perspective view of the beverage container, lid, and punch mechanism of FIG. 5, with the lid positioned on an elevated die of the punch mechanism and the punch mechanism returned to the open position, exposing the hole punched through the lid, according to various example embodiments.
Figure 7:
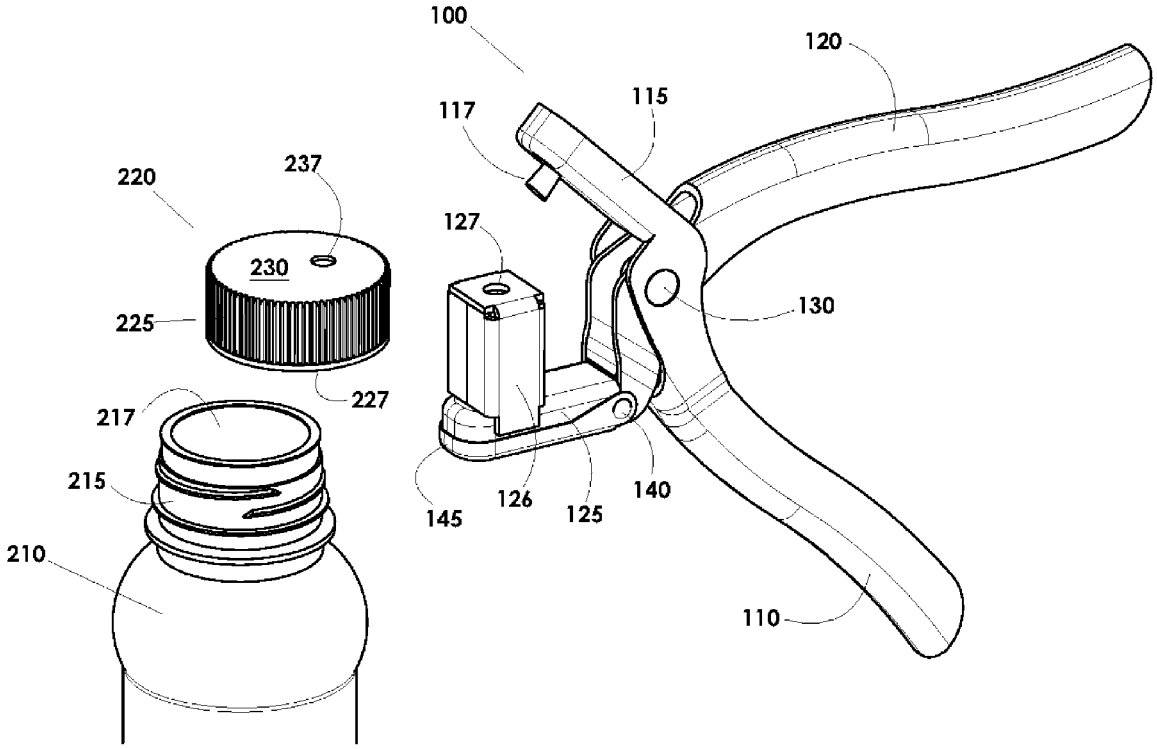
FIG. 7 is a front side perspective view of the beverage container, lid, and punch mechanism of FIG. 6, with the punched lid removed from the punch mechanism and the punch mechanism in an open position, according to various example embodiments.
Figure 8:
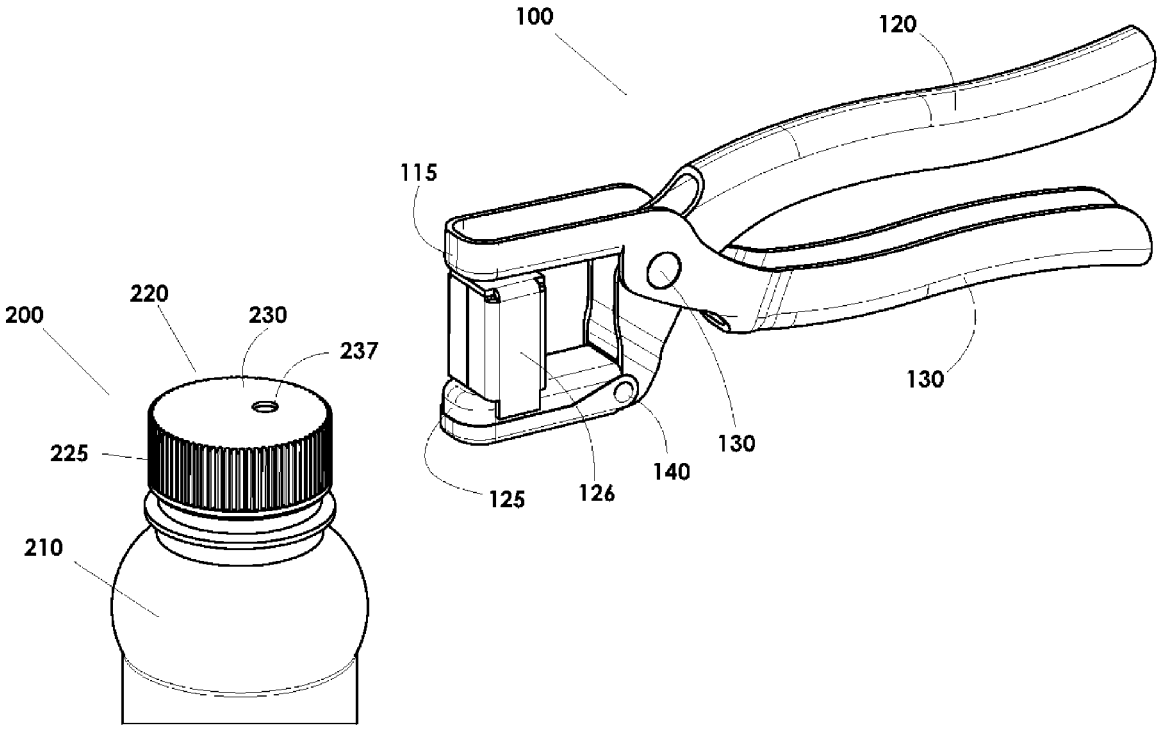
FIG. 8 is a front side perspective view of the beverage container, lid, and punch mechanism of FIG. 7, with the punched lid shown reinstalled on the beverage container and the punch mechanism optionally returned to the fully closed position, according to various example embodiments.

FIGS. 1 through 11 also demonstrate an example embodiment of a method of converting beverage containers 200 with removable and replaceable lids 220 into spill-resistant sippy cups. As depicted in FIGS. 1 and 2, a user may remove a lid 220 from a beverage container 210 at least substantially filled with a beverage 217 (not shown), for instance by unscrewing the lid 220 from threads 215 on the container 210. The lid 220 may comprise a longitudinally extending sidewall 225 and an upper portion 230 having inner 227 and outer surfaces. As shown in FIGS. 2 through 6, a user may punch a hole 237 through the upper portion 230 of the lid 220 by placing the upper portion 230 of the lid on a die 127 of a punch mechanism 100, and then clasping and pushing together a die handle 120 and a punch handle 110 of the punch mechanism 100, thereby causing the punch mechanism 100 to drive a punch 117 through the upper portion 230 of the lid 220 and into the die 127, thereby creating a hole-punched lid 220 (i.e., a lid 220 with a hole 237 punched there through), for instance as shown in FIGS. 6 through 9. As depicted in FIGS. 5 through 7, the user may cause the punch mechanism 100 to remove the punch 117 from the hole-punched lid 220, and remove the hold-punched lid 220 from the die 127 of the punch mechanism 100. As shown in FIGS. 7 through 10, the user may replace the hole-punched lid 220 on the beverage container 210 containing the beverage (not shown).

The user may partially insert a drinking straw 300 through the hole 237 into the beverage in the beverage container 200, such that one or more air gaps 400 are formed between the hole 237 and an exterior surface of the drinking straw 300, for example as depicted in FIGS. 12A through 12D. The one or more air gaps 400 are preferably sufficiently large in size to facilitate sipping the beverage through the drinking straw; that is, the air gaps 400 are preferably sufficiently large to allow air to travel from outside the container 200 into the container 200 as the beverage is extracted through the straw 300 during drinking. At the same time, the one or more air gaps 400 are preferably sufficiently small in size to substantially prevent leakage (i.e., no more than a few drops) of the beverage out of the container 200 and the drinking straw 300 if the beverage container 200 is tipped over such that the beverage rests against the inner surface 227 of the upper portion 230 of the lid 220. For example, as previously mentioned an air gap 400 having a cross-sectional area at any point of about 0.020 inches by 0.020 inches has been found to work acceptably with typical beverages, but persons of skill in the art may determine other shapes and sizes of air gaps 400 that work appropriately well, all of which is intended to be within the scope of the invention. This spill-resistant feature occurs because the air gaps 400 are sufficiently small that when the container 200 is tipped over, for instance sideways, a hydraulic lock is formed in the interior 217 of the container preventing the beverage from running out of the straw 300 under normal atmospheric conditions and when the container 200 is not being crushed or deformed. But a user sucking on the exposed upper end 320 of the straw 300 creates enough of a vacuum that air is sucked through the air gaps 400 allowing the liquid beverage to flow out through the straw 300.

Figure 11:
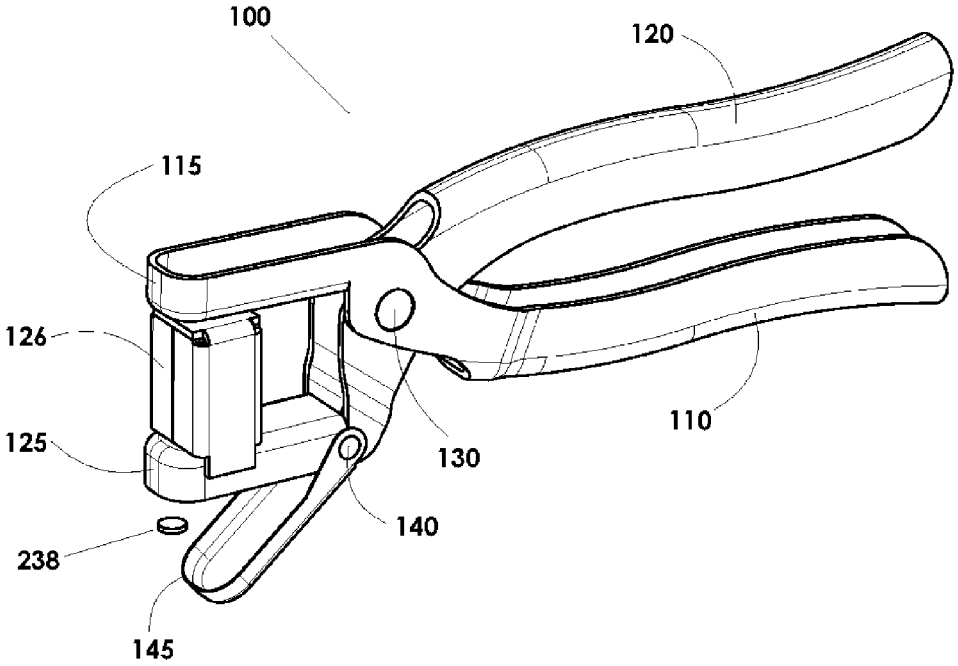
FIG. 11 is a front side perspective view of the punch mechanism of FIGS. 8-10, shown with an open scrap receptacle and a scrap slug that had been punched out of the lid and passed through the elevated die and into the scrap receptacle, according to various example embodiments.

As depicted in FIG. 11, the method may further comprise opening a scrap receptacle portion 145 of the punch mechanism 100 by rotating the scrap receptacle portion 145 about a pivot joint 140, and removing therefrom a scrap slug 238 that had been punched out of the lid 220 in the foregoing steps. In various example embodiments the method may further comprise tipping over the beverage container 200 such that the beverage rests against the inner surface 227 of the upper portion 230 of the lid 220, and leaking less than a substantial amount (typically no more than a few drops) of the beverage out of the container 200 and the drinking straw 300 (meaning out of the container 200 or the drinking straw 300 or both).

In various example embodiments the longitudinally extending sidewall 225 of the lid 220 extends longitudinally for a first distance h1, and the die 127 of the punch mechanism 100 is elevated above the die handle 125 by a second distance h2, which may be greater than the first distance h1. In this example embodiment the step of placing the upper portion 230 of the lid 220 on the die 127 of the punch mechanism 100 further comprises the steps of positioning the lid 220 so that the longitudinally extending sidewall 225 surrounds the die 127 that is elevated (for instance by stamped structure 126) above the die handle 125, for instance as depicted in FIG. 3. In various example embodiments the longitudinally extending sidewall 225 of the lid 220 extends longitudinally for a first distance of at least 0.200 inches, and the die 127 of the punch mechanism 100 is elevated above the die handle 125 by a second distance greater than the first distance.

As indicated in FIG. 12A, in various example embodiments the step of punching a hole 237 through the upper portion 230 of the lid 220 comprises punching a round hole 227 of a first diameter through the upper portion 230 of the lid 220 using a round punch 117A, and the step of partially inserting a drinking straw 300 through the hole 237 includes the drinking straw 300 having a round cross-section and a second diameter smaller than the first diameter, as shown in FIG. 12A. In various example embodiments the drinking straw 300 has a round cross-section and a second diameter smaller than the first diameter by 0.010 inches to 0.030 inches, or alternatively by 0.015 inches to 0.025 inches, for example, which creates an air gap 400 between the outside surface of the straw 300 and the hole 237 (which will have substantially the same size and shape as the punch 117A that created the hole 237).

Likewise as indicated in FIGS. 12B-12D, in various example embodiments the step of punching a hole 237 through the upper portion 230 of the lid 220 further comprises the hole having one or more slots (shown in FIGS. 12B-12D as example triangular or square shapes extending radially outward from the outer profile of example punches 117B-117D) extending radially outward from an otherwise round perimeter of the hole 237, and such that the one or more slots form the one or more air gaps 400 between the hole (e.g., shapes 117B-117D) and the exterior surface of the drinking straw 300, for example as shown in FIGS. 12B-12D. Any suitable number, size, and shape of slots may be used; those shown in the Figures are just examples.

Any suitable materials and methods of manufacture may be used for the system 100, 300. For example, drinking straws 300 may be conventional plastic drinking straws of a predetermined and consistent cross-sectional diameter. Drinking straws 300 are preferably made from recycled and recyclable plastic, and may be formed from biodegradable materials known to persons of skill in the art. Punch mechanism 100 may be formed from any suitably strong and durable material, for instance stamped steel, with a hardened steel punch 117. Systems 100, 300 are expected to be typically used to punch holes 237 in plastic caps 220 of all reasonable shapes, sizes, and material thicknesses, but metal caps such as those often used on tea bottles may likewise be pierced by the present system if it is constructed to be sufficiently strong. System 100, 300 may be packaged and sold as a kit marketed to parents of young children, with replacement proprietary-sized drinking straws 300 sold separately to periodically restock the user's supply.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements, if any, in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated. Certain information recited herein was obtained from the online encyclopedia Wikipedia, pursuant to Wikipedia's Creative Commons Attribution-ShareAlike License, available online.

Any of the suitable technologies set forth and incorporated herein may be used to implement various example aspects of the invention as would be apparent to one of skill in the art.

Although exemplary embodiments and applications of the invention have been described herein including as described above and shown in the included example Figures, there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that are allowed by the patent office based on this or any related patent application.

What is claimed is:

1. A method of converting beverage containers with removable and replaceable lids into spill-resistant sippy cups, comprising the steps of:

removing a lid from a beverage container at least substantially filled with a beverage, the lid comprising a longitudinally extending sidewall and an upper portion having inner and outer surfaces;

punching a hole through the upper portion of the lid by placing the upper portion of the lid on a die of a punch mechanism, clasping and pushing together a die handle and a punch handle of the punch mechanism, and causing the punch mechanism to drive a punch through the upper portion of the lid and into a die, thereby creating a hole-punched lid;

causing the punch mechanism to remove the punch from the hole-punched lid;

removing the hold-punched lid from the die of the punch mechanism;

replacing the hole-punched lid on the beverage container containing the beverage; and partially inserting a drinking straw through the hole into the beverage in the beverage container, such that one or more air gaps are formed between the hole and an exterior surface of the drinking straw, the one or more air gaps being sufficiently large in size to facilitate sipping the beverage through the drinking straw, the one or more air gaps being sufficiently small in size to substantially prevent leakage of the beverage out of the container and the drinking straw if the beverage container is tipped over such that the beverage rests against the inner surface of the upper portion of the lid.

2. The method of claim 1, further comprising the steps of:

opening a scrap receptacle portion of the punch mechanism and removing therefrom a scrap slug that had been punched out of the lid.

3. The method of claim 1, further comprising the steps of:

tipping over the beverage container such that the beverage rests against the inner surface of the upper portion of the lid; and leaking less than a substantial amount of the beverage out of the container and the drinking straw.

4. The method of claim 1, wherein the longitudinally extending sidewall of the lid extends longitudinally for a first distance, and the die of the punch mechanism is elevated above the die handle by a second distance greater than the first distance, and the step of placing the upper portion of the lid on the die of the punch mechanism further comprises the steps of:

positioning the lid so that the longitudinally extending sidewall surrounds the die that is elevated above the die handle.

5. The method of claim 1, wherein the longitudinally extending sidewall of the lid extends longitudinally for a first distance of at least 0.200 inches, and the die of the punch mechanism is elevated above the die handle by a second distance greater than the first distance, and the step of placing the upper portion of the lid on the die of the punch mechanism further comprises the steps of:

positioning the lid so that the longitudinally extending sidewall surrounds the die that is elevated above the die handle.

6. The method of claim 1, wherein the step of punching a hole through the upper portion of the lid further comprises the step of punching a round hole of a first diameter through the upper portion of the lid, and the step of partially inserting a drinking straw through the hole further comprises the step of inserting a drinking straw through the hole where the drinking straw has a round cross-section and a second diameter smaller than the first diameter.

7. The method of claim 1, wherein the step of punching a hole through the upper portion of the lid further comprises the step of punching a round hole of a first diameter through the upper portion of the lid, and the step of partially inserting a drinking straw through the hole further comprises the step of inserting a drinking straw through the hole where the drinking straw has a round cross-section and a second diameter smaller than the first diameter by 0.010 inches to 0.030 inches.

8. The method of claim 1, wherein the step of punching a hole through the upper portion of the lid further comprises the step of punching a round hole of a first diameter through the upper portion of the lid, and the step of partially inserting a drinking straw through the hole further comprises the step of inserting a drinking straw through the hole where the drinking straw has a round cross-section and a second diameter smaller than the first diameter by 0.015 inches to 0.025 inches.

9. The method of claim 1, wherein the step of punching a hole through the upper portion of the lid further comprises the step of punching a hole through the upper portion of the lid such that the hole has one or more slots extending radially outward from an otherwise round perimeter of the hole, and such that the one or more slots form the one or more air gaps between the hole and the exterior surface of the drinking straw.

* * * * *